US005967559A

United States Patent [19]

Abramowitz

[11] Patent Number: 5,967,559

[45] Date of Patent: Oct. 19, 1999

[54] RAPID VISUAL IMPACT PATIENT IDENTIFIER AND METHOD

[76] Inventor: Joseph M. Abramowitz, 5341 Vista Del Dios, San Diego, Calif. 92130

[21] Appl. No.: 09/005,330

[22] Filed: Jan. 9, 1998

[51] Int. Cl.[6] ..... B42D 15/00

[52] U.S. Cl. ..... 283/67; 283/70; 283/75; 283/900

[58] Field of Search ..... 283/67, 70, 74, 283/75, 900, 117, 81; 40/633

[56] References Cited

U.S. PATENT DOCUMENTS

| | | | |
|---|---|---|---|
| 4,122,947 | 10/1978 | Falla | 206/569 |
| 4,476,381 | 10/1984 | Rubin | 235/375 |
| 4,582,018 | 4/1986 | Fleck et al. | 116/321 |
| 4,865,549 | 9/1989 | Sonsteby | 434/262 |
| 4,869,531 | 9/1989 | Rees | 283/67 |
| 5,002,212 | 3/1991 | Charleton | 283/900 X |
| 5,026,084 | 6/1991 | Pasfield | 283/75 |
| 5,071,168 | 12/1991 | Shamos | 283/117 |
| 5,171,039 | 12/1992 | Dusek | 283/75 |
| 5,193,855 | 3/1993 | Shamos | 283/900 X |
| 5,197,764 | 3/1993 | Hicinbothem et al. | 283/81 |
| 5,262,944 | 11/1993 | Weisner et al. | 364/413.02 |
| 5,381,487 | 1/1995 | Shamos | 382/2 |
| 5,653,472 | 8/1997 | Huddleston et al. | 283/900 X |

*Primary Examiner*—Willmon Fridie, Jr.

*Attorney, Agent, or Firm*—Frank G. Morkunas

[57] ABSTRACT

The present invention involves a patient identifier processed and displayed on a printable medium and a method of generating the identifier. The identifier is generated from a block of identifying information in a health-care facility's data base. It is structured in segments for rapid visual or tactile discernment of patient-specific information, treatment-specific information, and facility-specific information for a particular patient. The identifier takes the form of different symbols, alpha-numerics, and geochromes (color and shapes). Patient-specific information has a numeric portion of two or more numbers with at least one of the numbers being enlarged and positioned at an outer edge of the identifier, an alpha portion of two or more letters with at least one of the letters being enlarged and positioned at an opposite outer edge. Between the alpha and numeric portion is a geochrome segment made of one or more colors in combination with one or more shapes or one or more patterns. The configuration of the geochrome represents patient-specific triage information such as risk category and urgency of care. The identifier contains one or more symbols of a clearly discernible design which correlates to a medical procedure, to the body part involved, and to treatment alerts (such as allergies, drugs to be avoided, etc.). The method to generate the identifier utilizes the admission records, extracts data, checks against duplication with other identifiers, makes corrections if duplication is discovered, and generates the identifier.

36 Claims, 4 Drawing Sheets

FIG. 1
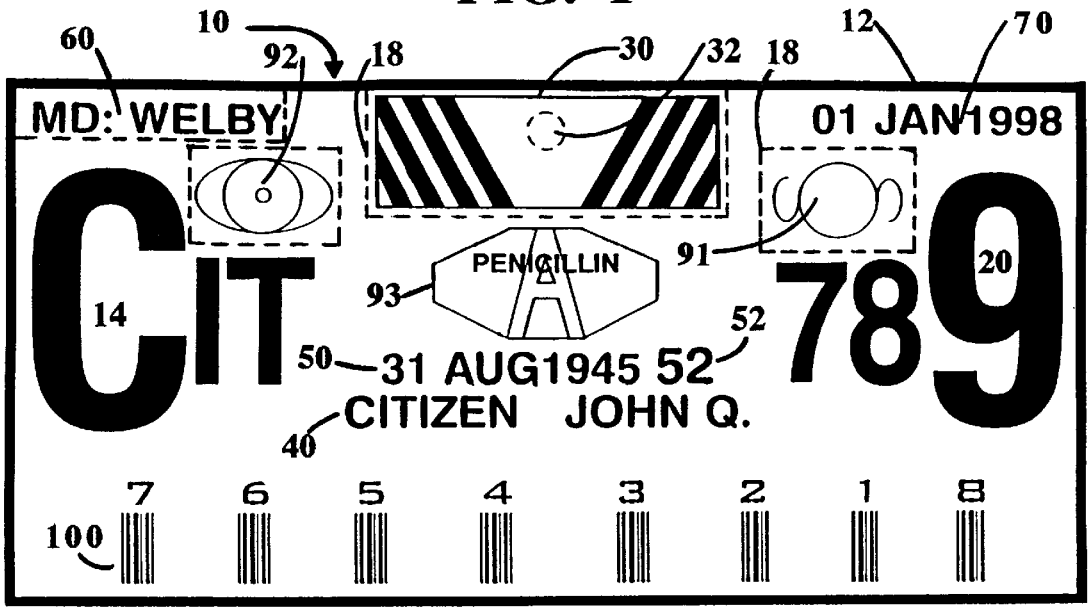
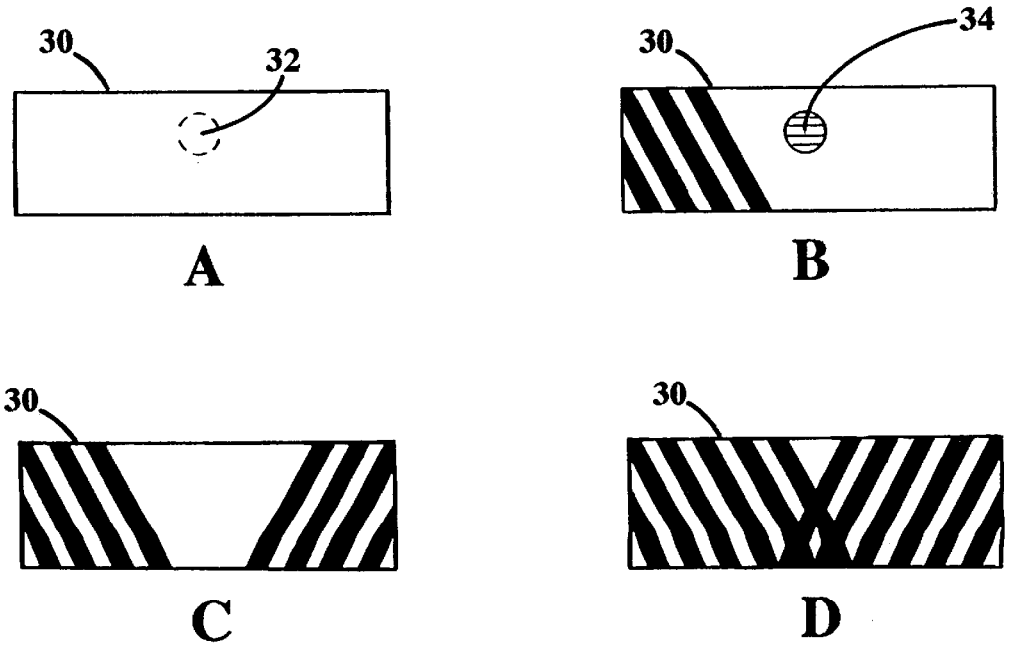
FIG. 2

RAPID VISUAL IMPACT PATIENT IDENTIFIER AND METHOD

CROSS REFERENCES TO RELATED APPLICATIONS

Not applicable.

STATEMENT REGARDING FEDERALLY-SPONSORED RESEARCH OR DEVELOPMENT

Not applicable.

BACKGROUND OF THE INVENTION

This present invention relates to an improved system of patient medical record identifiers and a method of generating such identifiers, or accessory patient artifact identifiers, and particularly to a system for unambiguous rapid identification of patients in treatment settings where time is always of the essence and name duplications are not infrequent. This identifier and method contemplates use in a clinical setting wherein a hospital stay generally does not exceed 24 hours—though in rare instances it could. The identifier and method also could conceivably be used in other settings involving in-patient charts and associated records and procedures.

Numerous patient identifiers and methods exist. Most are well suited for their intended purpose. None, however, permits for rapid, unambiguous visual identification and discernment of patient demographic, risk, urgency, and treatment-specifics as does the present invention. For example, in U.S. Pat. No. 4,122,947 issued to Falla a pre-packaged patient identification kit and method for insuring correlation with between patient, records, and specimens is disclosed. It is formed of a transparent package having a wristband, at least one specimen container, and a label. Each are pre-numbered with identical patient identifying indicia.

U.S. Pat. No. 4,476,381 issued to Rubin discloses a treatment method and system establishing a direct link between patient and test performed and medication and services administered. It includes a patient wristband to identify the patient and generate labels used at various stages of treatment.

U.S. Pat. No. 4,582,018 issued to Fleck disclosed a selectable medical indicator adapted for removable attachment to various medical-related records. It has color indicia, preset by staff, conveying treatment to be administered to the patient. It is a container-type device having multiple color stripes for the purpose indicated above, a clipping section, and an inside recess.

U.S. Pat. No. 4,865,549 issued to Sonsteby discloses a medical documentation and assessment apparatus adapted for controlling documentation and assessing skills of attending professionals. The apparatus is composed of a plurality of sections. Each section deals with a particular body system and contains numerous labels of different colors providing a series of assessment steps. The labels are peelable and usable on the chart of a patient during a patient's acute episode.

U.S. Pat. No. 5,026,084 issued to Pasfield discloses a color coded band to be mounted on the arm of a patient. Color codes represent certain care alert conditions. A similar color code is placed on the patient's chart. The charts have a list of care conditions which require early warning.

U.S. Pat. Nos. 5,071,168 and 5,381,487 issued to Shamos discloses a system of confirming the identity of a patient with that of the treatment to be administered to that patient.

It includes a means of obtaining a print characteristic of the patient, a means of obtaining a print characteristic of the person for whom treatment is intended; and a means of comparing and confirming the print characteristics of the two to ensure that they are the same.

U.S. Pat. No. 5,193,855 issued to Shamos disclosed patient and provider identification system which uses a data base of patient and provider information, and includes a means for obtaining an identification criteria of the patient (such as a fingerprint), a controller means for storing the fingerprint, a means for obtaining a fingerprint from the person for whom treatment is directed, a means for comparing the two fingerprints, and a means for responding to the comparison to thereby ensure the patient is the person for whom treatment is intended.

U.S. Pat. No. 5,197,764 issued to Hicinbothem discloses an alpha-numeric color-coded filing system using a plurality of different sized and coded labels. The sizes and colors have visually perceptible characteristics correspond to the specific alpha-numeric information and a folder. The folder is adapted to receive the various labels.

U.S. Pat. No. 5,262,944 issued to Weisner discloses a method of using color and selective highlighting to indicate critical events associated with a patient by way of a centralized monitoring system. The monitoring system includes a central station which receives patient information from bedside monitors and displays said information on a video display screen. Each video display is divided into sectors. One sector is associated with a single patient. When an alarm condition occurs, it is transmitted and displayed in that patient's sector on the video display. Background color in that sector changes indicating an alarm condition. The color change is easily distinguishable from normal sector colors.

Accordingly, several objects and advantages of my invention are:

- to provide for rapid identification of a patient in a health-care setting;
- to provide for rapid identification of the medical situation involving a patient in a health-care setting;
- to provide for rapid identification of treatment alerts, such as allergies and contra-indications to certain medication or treatment regimens;
- to provide for rapid identification of the anatomical part involved in treatment;
- to provide for rapid identification of a patient thereby ensuring against the wrong patient being treated;
- to provide for all the above in one single, easy-to-see and interpret, label or identifier for use with a patient on a chart, bedside, hospital record, clinical record, and lab record; and
- to provide for a method of easily generating the identifier from an existing admission data base, ensuring the identifier created does not duplicate that of another, and printing the identifier for use.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a patient identifier processed and displayed on a printable medium, and a method of generating the identifier. The identifier is structured for rapid visual discernment of segments relative to patient-specific information, treatment-specific information, and facility-specific information relative to a patient. The patient-specific information has a numeric indicia or portion of two or more numbers with at least one of the numbers being an enlarged primary numeric character positioned at an outer edge of a substrate on a suitable medium, an alpha indicia or portion of two or more letters with at least one of the letters being a primary alpha character and positioned at an opposite outer edge of the medium. The facility-specific information may include facility name, name of treating health-care provider (physician, therapist, and the like), admission date, the medical record number, and a bar code typically representing this number, and may be used as a scanned interface with facility hardware and software, allowing access to all data relevant to the patient, facility, and treatment.

Between the alpha and numeric indicia or portion is a geochrome segment made of, by way of example only and not by way of limitation, one or more colors in combination with one or more geometric patterns consisting of a variety of shapes and patterns. The geochrome is a vital component of the unique identifier composite and contains additional patient-specific information thereby serving the function of rapidly conveying triage (that is, the prioritization of attention pursuant to urgency of care and medical risk factors which may be involved) and other patient-specific information such as a patient's changed condition or status change to that of in-patient. The geochrome is configured according to these parameters.

The identifier contains one or more symbols, such as, but not limited to, icons of a clearly discernible design which correlate to treatment-related processes such as, but not limited to, a medical procedure, the anatomy involved, and treatment alerts (such as allergies).

The method to generate the identifier utilizes information in admission records, extracts required data, checks against duplication with other patient's identifiers, corrects the currently generating identifier if duplication is discovered, and generates one or more labels or identifiers for use throughout a patient's stay.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 1 is a preferred embodiment of the patient identifier.

FIGS. 2A–2D illustrate examples of geochrome configuration.

DETAILED DESCRIPTION OF THE INVENTION

Figure 3:
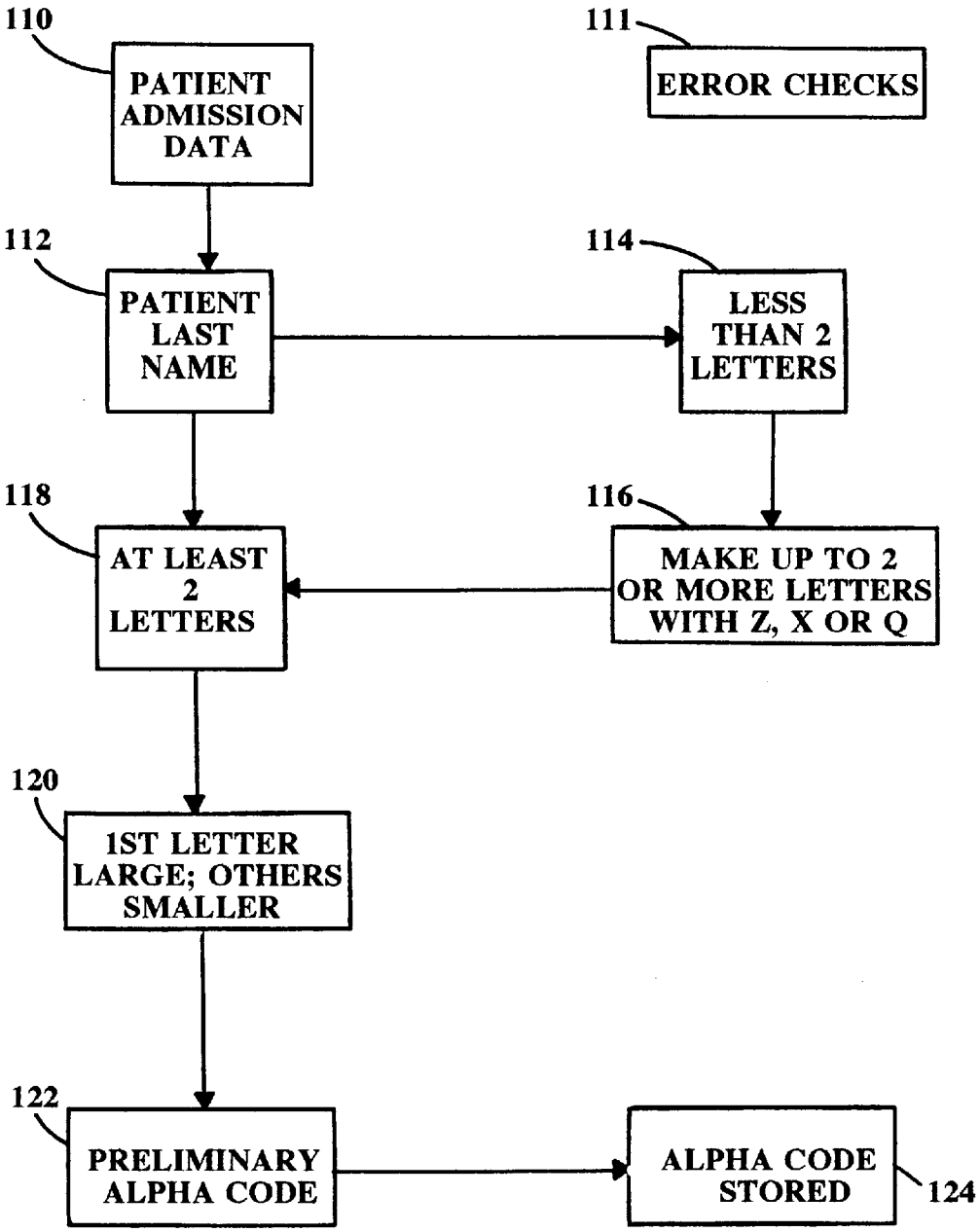
FIGS. 3–5 are flow charts illustrating the process of generating the patient identifier.

Referring now to the drawings in detail and in particular to FIG. 1, reference character 10 generally designates a patient identifier or label constructed in accordance with a preferred embodiment of the present invention. Flow charts of the method of generating the identifier are contained in FIGS. 3–5.

To appreciate the scope of the process, a discussion of FIG. 1, the final alphanumeric identifier or label containing patient information, follows. It must first be understood that the information associated with the alphanumeric identifier 10 is meant to be easily seen and rapidly interpreted and identified to a specific patient. It is printable and re-printable onto any suitable medium or substrate 12. The size of the medium 12 varies with the intended use of the identifier 10. In the event the identifier is printed onto self-adhesive labels, the labels should generally be of similar dimensions as that of the identifier and the adhesive would be the mounting means by which the identifier is mounted on an external object such as, but not limited to, a medical chart or other record of admission and/or treatment. Additional mounting structures could include, but are not limited to, hooks, clips, snaps, and the like.

The dimensions of the labels may range from between about 1×2 inches to about 2×4 inches. An optimal size for the identifier is 1.5×3 inches. If the identifier is printed on a standard sized sheet of paper, it may be printed at any location thereon. For ease of use, it is best that the identifier be printed at the periphery and preferably at a corner on the sheet of paper. The medium onto which the identifier is printed may be of any shape or color, although a substantially flat medium and white in color is preferred for ease of use and discernment of the various indicia on the identifier. In the event that the data management system in use calls for different colors of medium for different medical chart categories (such as described in U.S. Pat. No. 5,452,808 issued to this applicant), pale colors would be preferred to facilitate ease of use and discernment of the various indicia on the identifier.

The identifier 10 generally consists of an alpha code (also referred to herein as an alpha portion or indicia) 14, a numeric code (also referred to herein as a numeric portion or indicia) 20, a geochrome 30, and a plurality of other patient data (or segments) and facility-related data (or segments), such as, but not limited to patient's name 40, patient's date of birth 50, attending physician's or therapist's name 60, admission date 70, medical facility record number or name 80, treatment-specific indicia or segment (such as, but not limited to, a first set of symbols or icons 91 relating to the medical procedure involved, a second set of symbols or icons 92 relating to the anatomy involved, and a third set of symbols 93 relating to treatment alerts), and a bar code 100 reflect the medical record number 80 and incorporating some or all of the above segments, portions, and data into a visual or electronic format which is easily and rapidly accessed for retrieval or transfer.

The alpha indicia or portion 14 primarily consists of the first two or more letters of the patient's last name which are extracted from admission records. In the embodiment shown, the first three letters are used with the first letter being in an enlarged format for easy detection. This enlarged letter is referred to as the primary alpha character. The numeric indicia or portion 20 consists of the last two or more numerals of a patient's identifying number, such as a social security number. In the example, three such numerals are used with the last numeral displayed in enlarged format for easy detection. This enlarged number is referred to as the primary numeric character. Following this method, about 260 variations, without duplication of the primary characters, are available to a clinic in each 24-hour period.

The alpha portion 14 and the numeric portion 20 make up what is referred to as the alpha-numeric code for a patient. The primary characters of the alpha-numeric code are clearly visible and foster ease of identity of records, charts, labels, and the like associated with a single patient. They are generally displayed on the outer edges of the identifier 10 thereby fostering instant recognition and interpretation even at a casual glance. Using the method of the present invention and the identifier 10, no two patients will have the same two primary characters at the same health-care facility at the same time.

The geochrome segment 30 is an important facet to the identifier 10. Generally it is placed centrally, though it may be placed on any easily seen suitable location on the identifier 10. The geochrome 30 may be configured of a variety of colors, shapes, and patterns; individually or in combination with one another. The manner of configuration will depend on the needs of each specific health-care facility. Regardless of how configured, the geochrome segment 30 represents a vital component of the identifier conveying additional patient-specific triage information. By way of example only and not limitation, this additional patient-specific information could include a patient's risk classification or category (e.g., no health problems or risk, mild risk, moderate risk, or severe risk) and urgency of care (e.g., immediate, intermediate, normal). Any color or colors may be used for the geochrome. Any geometric patterns or shapes may be used. These may include, but are not limited to, one or more lines being vertical, horizontal, diagonal, or crossed; various geometric shapes such as, but not limited to, circles, ellipses, triangles, squares, rectangles, and the like. Patterns would be any one or more combinations of various shapes. A multitude of geochrome configurations are possible, each representing different additional patient-specific information. Additionally, the geochrome segment 30 allows a greater number of unique indicia permutations to be available than which is available with just the alpha-numeric indicia or portion (e.g., primary alpha, primary number plus geochrome, etc.). The geochrome segment 30 may also be configured for tactile discernment of the respective information thereon.

By way of example only and not limitation, FIGS. 2*a*–2*d* illustrate a geochrome segment 30 using no, or 3 variations of, diagonal lines in four different permutations to represent four different medical risk categories. In this example, no diagonal lines as illustrated in FIG. 2*a* represents no medical risk, a single set of diagonal lines on one-half of the geochrome as illustrated in FIG. 2*b* represents a mild risk, two sets of opposite-slanting diagonal lines as illustrated in FIG. 2*c* (with each set in only one-half of the geochrome) represents a moderate risk, and the same two sets of opposite slanting diagonal lines intersecting one another as illustrated in FIG. 2*d* represents a severe risk. Using this example again, a red background geochrome could represent immediate urgency, a yellow background geochrome could represent intermediate urgency, and a green background geochrome represent could normal urgency.

The sight of the geochrome segment 30, either alone or in combination with the alpha-numeric code, provides to the health-care provider and staff personnel, in an instantly and visually discernible manner, critical information on the patient's situation and status at the facility.

Other patient-specific information on the identifier 10 may include the patient's full name 40, the patient's date of birth 50, and the patient's age 52. Other facility-specific information may include the health-care provider's (physician's, therapist's) name 60, date of admission 70, and the health-care facility's name or number 80.

One or more symbols may be added to the identifier 10 to complement the unique rapid visual effect the identifier is structured to evoke. These symbols are indicia which represent treatment-specific information and relate to the treatment process involved (such as but not limited to the medical procedure involved, the anatomy involved, and treatment alerts). The symbols may take any shape or form and may include letter indicia, number indicia, or word indicia as necessary. Readily recognizable icons are best suited for the medical procedure and for the anatomy involved. Therefore, if icons are used, they should be configured in a manner that their visual appearance renders the procedure readily discernible to staff personnel. For example, a first set of symbols 91 or icons representing the medical procedure could depend upon the treatment setting (i.e., operating room, emergency room, etc.) or the therapeutic implement involved (such as a scalpel or a needle and a suture). The example illustrated in FIG. 1 reflects an intra-ocular lens implant. A second set of symbols 92 or icons would represent the anatomic part to be treated. As such, the icons would be, for example an eye if cataract surgery is involved, or an arm if a fractured radius is involved. The example illustrated in FIG. 1 reflects that the eye is the body part to be treated. A third set of symbols 93 would represent treatment alerts associated with the treatment-related process. This third set of symbols may include various shapes, colors, one or more letter symbols, or one or more word indicia. The example illustrated in FIG. 1 as reference character 93 bears a somewhat octagonal shape (representative of the international 'stop sign'), is red in color, bears the letter indicia 'A' (representative of an allergy treatment alert), and the word indicia 'PENICILLIN' (correlating to the letter indicia indicating that the patient is allergic to penicillin). As can be seen, the permutations for conveying information in a rapid, unambiguous, visual manner are virtually limitless.

The segments, portions, and indicia, all or some, are transferred to and printed (and may be re-printed as needed) on a suitable medium or substrate 12. The medium may be of any size as indicated earlier, may have plain backing or adhesive backing. The size and type medium 12 used will depend on the use of the identifier 10 at the facility.

The identifier 10 also is structured with means to accommodate a patient's changed condition or status or a change to treatment, procedure, or provider. FIGS. 1 and 2 are illustrative of such modification means 32. The modification means 32 in FIG. 1 may be comprised of perforations or other suitable structure adapted to readily removing a part of the identifier 10 and to expose its foundation or chart upon which it has been mounted. In any event, the removal of the perforated portion significantly alter the visual structure of the identifier 10 and thereby signifies a change or modification. This could represent any one of a number of modifications, such as but not limited to, a deteriorated condition, admission rather than out-patient treatment, need for observation, and the like. FIG. 2B illustrates the modified state 34 of a geochrome segment 30.

Should a patient's treatment or provider be changed, new treatment-specific portions, facility-specific portions, and the like may be placed on a previously prepared identifier 10. Rather than re-print the identifier and re-mount it, only the affected portions and segments need be replaced. Alignment means 18 on the identifier 10 facilitate proper placement. As illustrated in FIG. 1, alignment means in the preferred embodiment comprise at least two "corner" symbols in diagonal opposition to one another. Phantom lines represent the location of the respective segment or portion. Thus the identifier 10 is not only a rapid visually discernable identifier of important data, it is flexible to accommodate changed circumstances which often occur in clinical treatment settings.

It must also be understood that although emphasis has been placed on rapid visual discernment of portions and segments, the identifier may be configure for tactile discernment also.

Figure 4:
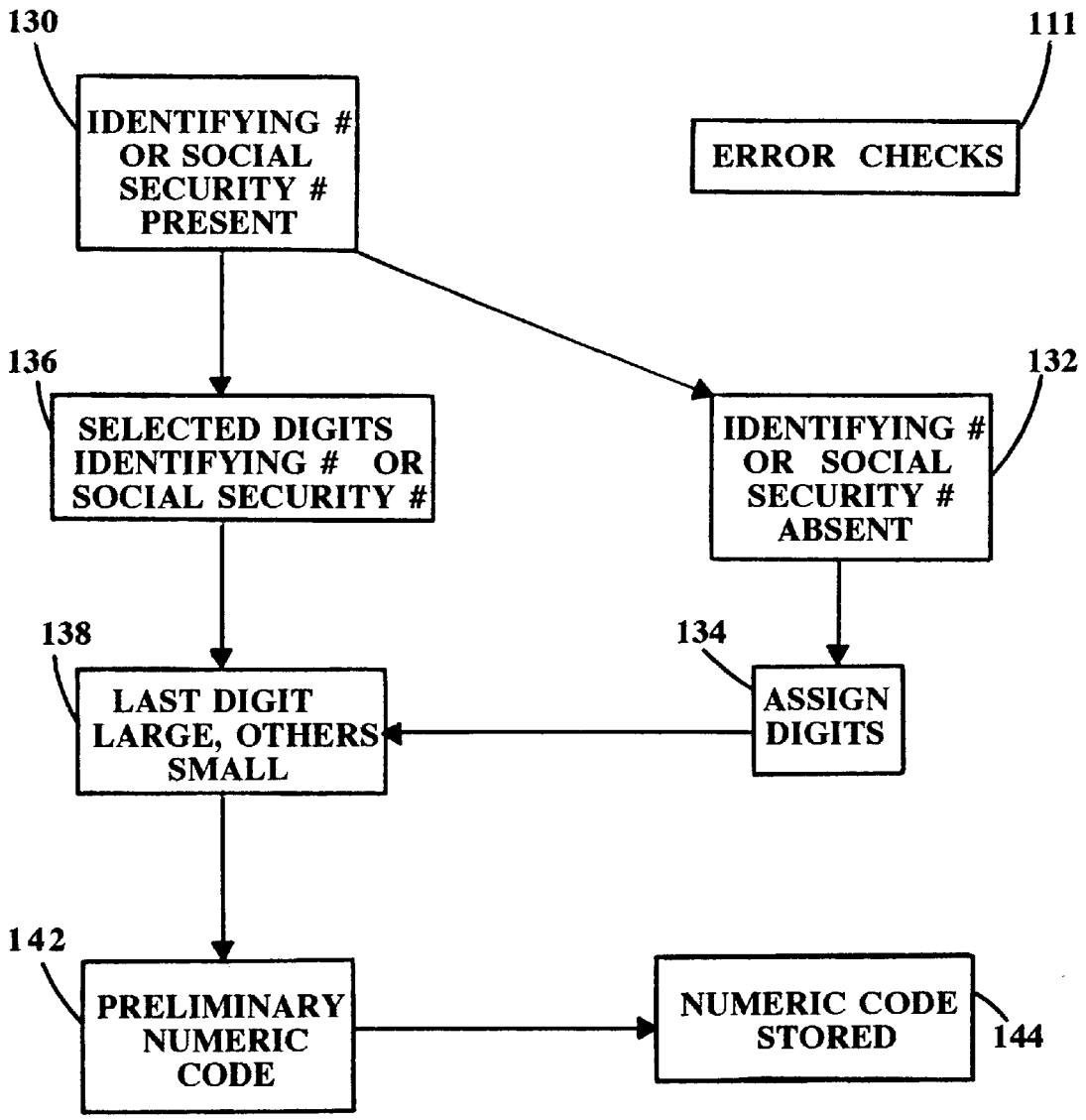
Figure 5:
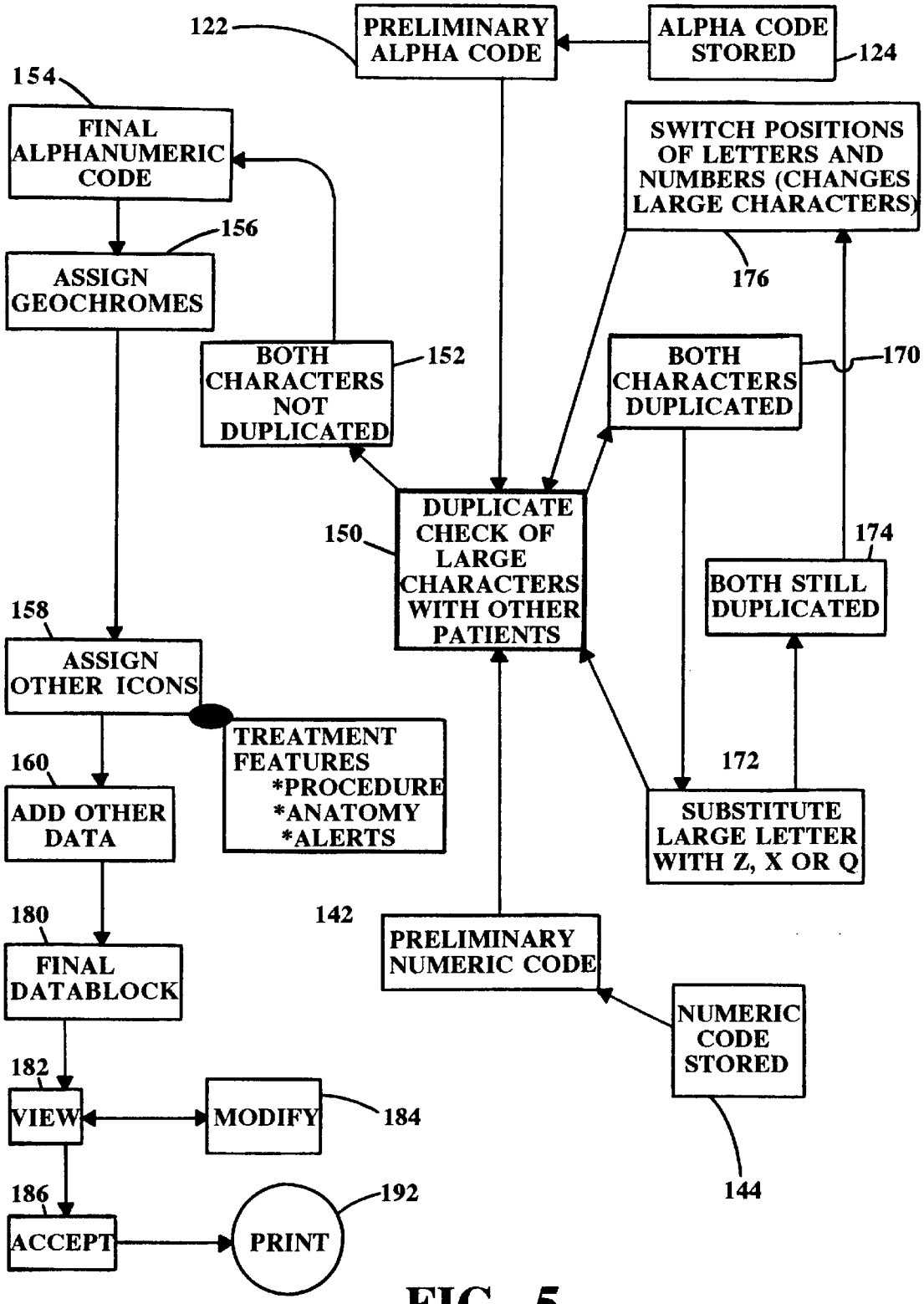

The flow chart of FIGS. 3–5 illustrates the process or method used in this system to generate the alphanumeric or final identifier label. The process may be executed manually or may be computer-assisted through associated software for quicker generation. The first step in the process is the generation of an alpha-numeric code. The alpha-numeric code is comprised of an alpha indicia 12 and a numeric indicia 20 (as shown in FIG. 1). In the discussion which follows, the generation of the alpha code 122 and the numeric code 140 is for illustration purposes only. The sequence (alpha code 122 first followed by numeric code 140) is not critical and either code may be generated first.

The process begins with the patient's admission data 110 which has been previously checked for errors and duplication of information with that of other patients at the facility 111. In generating an identifier, the patient's last name 112 is analyzed and, where the last name consists of 3 or more letters 118, those 3 or more letters are extracted and processed 120 thereby creating a preliminary alpha code 122. This code will, when finalized, become the alpha indicia 14 shown in FIG. 1. The first letter of the alpha code is then enlarged and the alpha code is stored or held for future use in the generation process. If the last name consists of less than 3 letters 114, the generating process randomly generates a 3rd letter 116 using a relatively uncommon letter such as Z, Q, or X and transmits that result for processing 120 and creation of a preliminary alpha code 122. The first letter of the preliminary alpha code 122 is enlarged. Each such preliminary code 122 is stored 124 or held for future use in the generation process.

FIG. 3 shows the generation of a numeric code 142. This code will, when finalized, become the numeric indicia 20 shown in FIG. 1. The generation process is similar to that of generating the alpha code. An identifying number associated with the patient is used 130. Typically, this number is the patient's social security number although any organized system of identifying numbers may be used. Such number 130 is first extracted from the previously error-checked patient admission data. The last three digits are retrieved from the admission data 136 and processed 138 into a preliminary numeric code 142. In this example, the preliminary numeric code 142 consists of three digits. The preliminary numeric code 142 is then stored 144 or held for future use in the generation process. If the patient has no social security number 132, a random preliminary numeric code is assigned 134.

At FIG. 5, each code (preliminary alpha and preliminary numeric) is retrieved from where stored or held and compared with other patient alpha-numeric codes for duplication of primary characters 150. If only one or no primary characters is located in other patient alpha-numeric codes, the current patient's alpha-numeric code has cleared the duplicate check 152 and a final alpha-numeric code is generated 154. This is followed by the assignment of appropriate geochromes 156 (as to additional patient-specifics), treatment-specific indicia 158 (as to medical procedure, body part involved, and treatment alerts), and other data 160 into a final data block 180. Information for the generation of the various geochromes, icons, and other data is extrapolated from the patient's admission data 110.

If the primary characters (numeric and alpha) of a patient's alpha-numeric code are duplicate of another's, a sequential substitution is performed 172 of first letters of the patient's last name with the letters Z or Q or X, basically in that order, until the primary alpha character letter is no longer a duplicate of that other patient's primary alpha character. If this step is unable to correct the duplication of alpha-numeric codes, the respective locations of the alpha indicia 14 and the numeric indicia 20 are switched with each other. The alpha indicia 14 of the alpha code 122 is moved to the location of the numeric indicia 20 of the numeric code 142 and the location of the numeric indicia 20 is moved into the location the alpha indicia 14 previously occupied with the primary characters of each being altered in the process. Once this duplication has been resolved, a final alpha-numeric code, along with the other matter discussed above, is assigned and conveyed into the final data block 180.

Each final data block is viewed 182 and either modified 184 or accepted 186 for printing 192 of the alpha-numeric label or identifier 10 onto a suitable medium 12. In the preferred embodiment the positions and locations of the various indicia are as shown in FIG. 1. This placement has been found to be the best suited for the most rapid discernment of information, at a glance, associated with the indicia. It must be understood that other positions and locations may be used.

The present disclosure includes that contained in the present claims as well as that of the foregoing description. Although this invention has been described in its preferred form with a certain degree of particularity, it is understood that the present disclosure of the preferred form has been made only by way of example and numerous changes in the details of construction and combination and arrangement of parts and method steps may be resorted to without departing from the spirit and scope of the invention. In particular, the respective indicia may be positioned anywhere on the identifier, any colors may be used where colors are called for, any geometric patterns may be used where geometric patterns are called for, and any symbols or icons may be used where such are called for. Accordingly, the scope of the invention should be determined not by the embodiemnt[s] illustrated, but by the appended claims and their legal equivalents.

The invention claimed is:

1. A patient identifier for rapid visual discernment of information relative to a patient comprising:

a. a substrate with means on said substrate defining (1) a patient-specific segment comprising a numeric portion having two or more numbers associated with a patient wherein at least one of said numbers is a primary numeric character positioned at an outer edge of said patient identifier, and further comprising an alpha portion having two or more letters associated with a patient wherein at least one of said letters is a primary alpha character positioned at another outer edge of said patient identifier;

(2) a facility-specific segment representative of a health-care facility;

(3) a geochrome segment comprised of at least one color in combination with at least one geometric pattern, said geochrome segment being associated with a patient which, depending on the combination color and geometric pattern is representative of additional patient-specific information; and (4) at least one treatment-specific segment on said identifier representative of a treatment-related procedure for the patient; and b. means for mounting said identifier to another object.

2. The identifier as defined in claim 1 further comprising a modification means for modifying the information conveyed by said identifier to represent a change of condition of the patient, said modification means comprising a plurality of perforation means on said substrate adapted to remove a part of the identifier and alter its visual structure.

3. The identifier as defined in claim 1 further comprising an alignment means adapted to receive and align on said identifier additional treatment-specific segments, additional facility-specific segments, and additional geochrome segments.

4. The identifier as defined in claim 1 wherein said primary numeric character is substantially larger than said other numbers.

5. The identifier as defined in claim 1 wherein said primary alpha character is substantially larger than said other letters.

6. The identifier as defined in claim 1 wherein said patient-specific portion further comprises a separately located readable segment representing the patient's date of birth.

7. The identifier as defined in claim 1 wherein said patient-specific portion further comprises a separately located readable segment representing the patient's full name.

8. The identifier as defined in claim 1 wherein said patient-specific portion further comprises a separately located readable segment representing the patient's age.

9. The identifier as defined in claim 1 wherein said facility-specific information further comprises a separately located readable segment of a name of a treating health-care provider.

10. The identifier as defined in claim 1 wherein said facility-specific information further comprises a separately located readable segment of an identity of the health-care facility.

11. The identifier as defined in claim 1 wherein said facility-specific information further comprises a separately located readable segment of the patient's admission date to the health-care facility.

12. The identifier as defined in claim 1 wherein said facility-specific information further comprises a separately located bar code segment containing data representative of said patient-specific information, treatment-specific information, and facility-specific information.

13. The identifier as defined in claim 1 wherein one of said at least one treatment-specific portion correlating to a treatment-related process comprises a first set of symbols representative of a specific medical procedure associated with the treatment-related process.

14. The identifier as defined in claim 13 wherein said first set of symbols are icons of said medical procedure.

15. The identifier as defined in claim 1 wherein one of said at least one treatment-specific portion correlating to a treatment-related process comprises a second set of symbols representative of an anatomical part associated the treatment-related process.

16. The identifier as defined in claim 15 wherein said second set of symbols are icons of said anatomical part.

17. The identifier as defined in claim 1 wherein one of said at least one treatment-specific portion correlating to a treatment-related process comprises a third set of symbols representative of contra-indications associated with treatment.

18. The identifier as defined in claim 17 wherein said third set of symbols further comprises a color segment as a treatment alert.

19. The identifier as defined in claim 17 wherein said third set of symbols further comprises a word segment as a treatment alert.

20. The identifier as defined in claim 17 wherein said third set of symbols further comprises at least one alphabetic letter indicia as a treatment alert.

21. A method of creating, from admission records of a health-care facility, a rapidly discernible patient identifier for identifying a patient to treatment comprising the steps of:

a. retrieving a patient's last name;

b. establishing a preliminary alpha code for said patient by identifying at least the first two letters of said last name and creating a primary alpha character by making a first letter of said at least two letters larger;

c. retrieving a patient's identifying number;

d. establishing a preliminary numeric code for said patient by identifying at least two last numbers of said identifying number and creating a primary numeric character by making a last number of said at least two last numbers larger;

e. assigning a final alpha-numeric code by conducting a duplicate check of said preliminary alpha code and said preliminary numeric code against alpha-numeric codes of other patients at the health-care facility to ensure against a duplication of said final alpha-numeric code;

f. assigning additional patient-specific information to said identifier in the form of a geochrome;

g. creating a data block of all information assigned to the identifier;

h. printing the identifier from said data block such that said identifier to have a primary numeric character on an outer edge of said identifier, a primary alpha character on another outer edge of said identifier, and a geochrome on said identifier.

22. The method as defined in claim 21 further comprising the step of respectively switching positions of said primary alpha code with that of said primary numeric code after conducting said duplicate check and discovering that the patient's primary alpha code and primary numeric code match those of another patient.

23. The method as defined in claim 22 further comprising the step of conducting a second duplicate check.

24. The method as defined in claim 23 further comprising the steps substituting the patient's primary alpha character with a letter taken from a series of letters consisting of Z, Q, or X if a patient's primary alpha code and primary numeric code match the alpha-numeric code of another patient after conducting said second duplicate check.

25. The method as defined in claim 21 further comprising the step of assigning a first set of symbols to said identifier in the form of visually discernible icons relative to a medical procedure involved in treatment.

26. The method as defined in claim 21 further comprising the step of assigning a second set of symbols to said identifier in the form of visually discernible icons relative to an anatomical body part involved in treatment.

27. The method as defined in claim 21 further comprising the step of assigning a third set of symbols to said identifier wherein said third set of symbols represent contra-indications to treatment.

28. The method as defined in claim 27 wherein said third set of symbols comprises a geometric shape representing a treatment alert.

29. The method as defined in claim 27 wherein said third set of symbols comprises an alphabetic indicia representing a treatment alert.

30. The method as defined in claim 27 wherein said third set of symbols comprises a word indicia representing a treatment alert.

31. The method as defined in claim 21 further comprising the step of assigning facility-specific information to said identifier.

32. The method as defined in claim 21 further comprising the step of assigning a color to said geochrome, said color being representative of a patient's urgency of care.

33. The method as defined in claim 21 further comprising the step of assigning a geometric pattern to said geochrome, said geometric pattern being representative of a patient's medical risk category.

34. The method as defined in claim 21 further comprising the step of placing said geochrome substantially in between said primary alpha character and said primary numeric character.

35. The method as defined in claim 21 further comprising the step of viewing said data block and accepting or modifying said information contained therein.

36. The method as defined in claim 21 wherein said identifying number is the patient's social security number.

* * * * *